US008394754B2

(12) United States Patent
Zerhusen

(10) Patent No.: US 8,394,754 B2
(45) Date of Patent: Mar. 12, 2013

(54) AMPHIPHILE-CONTAINING PERFUME COMPOSITIONS

(75) Inventor: Jaden Scott Zerhusen, Florence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 160 days.

(21) Appl. No.: 13/078,072

(22) Filed: Apr. 1, 2011

(65) Prior Publication Data

US 2011/0245143 A1 Oct. 6, 2011

Related U.S. Application Data

(60) Provisional application No. 61/319,951, filed on Apr. 1, 2010, provisional application No. 61/430,672, filed on Jan. 7, 2011.

(51) Int. Cl.
*C11D 3/50* (2006.01)

(52) U.S. Cl. ..... 510/499; 510/522; 510/527

(58) Field of Classification Search ..... 510/499, 510/522, 527
See application file for complete search history.

(56) References Cited

U.S. PATENT DOCUMENTS

| | | | | |
|---|---|---|---|---|
| 5,500,137 | A | 3/1996 | Bacon et al. | |
| 5,500,138 | A | 3/1996 | Bacon et al. | |
| 5,500,154 | A | 3/1996 | Bacon et al. | |
| 5,652,205 | A | 7/1997 | Hartman et al. | |
| 5,652,206 | A * | 7/1997 | Bacon et al. | 510/101 |
| 5,780,404 | A | 7/1998 | Bacon et al. | |
| 6,491,728 | B2 | 12/2002 | Bacon et al. | |
| 7,405,187 | B2 | 7/2008 | Frankenbach et al. | |
| 2003/0104963 | A1 * | 6/2003 | Demeyere et al. | 510/327 |
| 2003/0216280 | A1 * | 11/2003 | Martens et al. | 510/466 |
| 2007/0275866 | A1 | 11/2007 | Dykstra | |

FOREIGN PATENT DOCUMENTS

| | | | |
|---|---|---|---|
| WO | 2006132979 | A2 | 12/2006 |
| WO | 2007138562 | A2 | 12/2007 |

OTHER PUBLICATIONS

International Search Report; International Application No. PCT/US2011/030849; date of mailing Jul. 15, 2011; 3 pages.

* cited by examiner

*Primary Examiner* — John Hardee
(74) *Attorney, Agent, or Firm* — James F. McBride; Steven W. Miller

(57) ABSTRACT

Concentrated perfume compositions having an amphiphile are useful for incorporating perfume into concentrated fabric softener compositions.

20 Claims, No Drawings

AMPHIPHILE-CONTAINING PERFUME COMPOSITIONS

CROSS REFERENCES TO RELATED APPLICATIONS

This application claims priority to and benefit of U.S. Provisional Patent Application No. 61/319,951, filed Apr. 1, 2010, and U.S. Provisional Patent Application No. 61/430,672, filed Jan. 7, 2011.

FIELD OF INVENTION

The present invention relates to methods of making perfumed fabric softener compositions

BACKGROUND OF THE INVENTION

Liquid fabric softener compositions comprising dispersed lamellar phases are typically not miscible with perfume oils. This problem is exacerbated in concentrated or compacted formulations containing high fabric softening active (i.e., 10% and higher) and a high level of perfume (i.e., 1.0% and higher). The problem is yet even further exacerbated when the fabric softening active is an ester quaternary ammonium compound at a relatively low Iodine Value (e.g., 18-22). However, perfuming the fabric softener compositions is essential to secure high consumer acceptance. Fabric softener compositions with a pleasant neat product odor that also deliver a pleasant odor through the wash process and ultimately to dry fabrics are far more desirable to the consumer than un-perfumed fabric care products. There is need to solve these problems while simplifying formulations thereby minimizing production and formulation costs. There is a need to solve these problems while making a product that is stable over time. See e.g., U.S. Pat. No. 7,405,187.

SUMMARY OF THE INVENTION

The present invention attempts to achieve one or more of these needs by employing, in one aspect of the present invention, a method of making a perfumed fabric softener composition comprising the steps: providing a fabric softener active composition comprising 10% to 20% by weight of the fabric softener active composition; providing a perfume composition comprising 1.0% to 2.5% of perfume ingredients by weight of the perfume composition; mixing an amphiphile with the neat perfume composition to obtain an amphiphile/perfume mixture; and adding the amphiphile/perfume mixture to the fabric softener active composition to make the perfume fabric softener composition.

Another aspect of the invention provides for a method of making a perfumed fabric softener composition comprising the steps: providing a fabric softener active composition comprising 10% to 20% by weight of the fabric softener active composition; providing an amphiphile/perfume mixture, wherein the amphiphile/perfume mixture comprises from 25% to 95% of perfume ingredients; adding the amphiphile/perfume mixture to the fabric softener active composition to make the perfumed fabric softener composition.

DETAILED DESCRIPTION OF THE INVENTION

Fabric Softener Active Compositions A first aspect of the invention comprises providing a fabric softener active composition comprising 10% to 20%, alternatively from 10% to 15%, alternatively 15% to 20%, alternatively 16% to 18%, alternatively combinations thereof, by weight of the composition, of an ester quaternary ammonium compound suitable for softening fabric. An example of an ester quaternary ammonium compound includes bis-(2-hydroxyethyl)-dimethylammonium chloride fatty acid ester having an average chain length of the fatty acid moieties of from 16 to 20 carbon atoms, preferably 16 to 18 carbon atoms, and an Iodine Value (IV), calculated for the free fatty acid, of from 15 to 25, alternatively from 18 to 22, alternatively from about 19 to about 21, alternatively combinations thereof. The Iodine Value is the amount of iodine in grams consumed by the reaction of the double bonds of 100 g of fatty acid, determined by the method of ISO 3961.

In one embodiment, the fabric softener active composition comprises a pH from 2 to 4, alternatively from 2.5 to 3.5. The pH may be adjusted with the use of hydrochloric acid or formic acid.

In another embodiment, the fabric softener active composition is free or substantially free of neat perfume.

Perfumes

Another aspect of the invention provides a neat perfume composition, preferably a concentrated neat perfume composition. As used herein, the term "perfume" includes fragrant substance or mixture of substances including natural (i.e., obtained by extraction of flowers, herbs, leaves, roots, barks, wood, blossoms or plants), artificial (i.e., a mixture of different nature oils or oil constituents), and synthetic (i.e., synthetically produced) odoriferous substances. Such materials are often accompanied by auxiliary materials, such as fixatives, extenders, stabilizers and solvents. These auxiliaries are not included within the meaning of "perfume", as used herein. Typically, perfumes are complex mixtures of a plurality of organic compounds.

The compositions of the present invention may comprise a neat perfume and/or perfume technology systems that can be combined to yield the desired scent experience from the store shelf stage of a product, through its total performance cycle. Suitable perfumes include those perfumes that are enduring perfumes and/or quadrant perfumes. Examples of such neat perfumes are disclosed U.S. Pat. Nos. 5,500,138; 5,500,154; 6,491,728; 5,500,137 and 5,780,404. Suitable perfume delivery systems, methods of making certain perfume delivery systems and the uses of such perfume delivery systems are disclosed in USPA 2007/0275866 A1.

Perfumes are typically mixtures of polar and non-polar oils. A composition comprising oils, even when some of these oils are polar, is not easily dispersed in a water continuous composition such as a fabric softening compositions. Not to be bound by theory, but a perfume must be finely subdivided in the continuous water phase of a fabric softening composition to enable adsorption of the perfume by the dispersed lamellar phase(s). One generally predicative measure of a perfume oil's dispersibility in water continuous compositions may include the perfume dielectronic constant. Perfumes with a lower dielectric constant, or the less polar perfumes, are more likely to be difficult to incorporate into fabric softener compositions comprising dispersed lamellar phases because such perfumes are more cohesive in an aqueous environment and thus require more mechanical energy to be subdivided in this environment.

In one embodiment, the perfume composition of the present invention may have a combined dielectric constant below about 12, or 11, or 10, or 9, or 8, or 6, or 5, or 4, alternatively greater than about 1. The dielectronic constant can be measured by a Dielectric Constant Meter model 870 made by Scientifica.

Another generally predictive measure of a perfume's dispersibility in water continuous compositions may include a perfume ingredient's Log P that is the perfume ingredient's partition coefficient between water and octanol. One way of measuring Log P of a perfume ingredient is using the "ClogP" program from BioByte Corp (e.g., ClogP Version 4.0 and Manual 1999). CLOGP USER GUIDE, Version 4.0, BioByte Corp, (1999) (http://www.biobyte.com/bb/prod/clogp40.html) is incorporated herein by reference. Another suitable way of measuring Log P is using the CLOGP program from Daylight Chemical Information Systems, Inc. of Aliso Viejo, Calif. The CLOGP Reference Manual, Daylight Version 4.9, Release Date Feb. 1, 2008 (http://www.daylight-.com/dayhtml/doc/clogp/index.html), incorporated herein by reference. Not to be bound by theory, but higher a perfume ingredient's Log P, the higher the ingredient's hydrophobicity, and the more difficult, e.g., more mechanical energy required, to incorporate the perfume ingredient in a fabric softener composition. A non-limiting set of perfumes ingredients that comprise a perfume are disclosed in U.S. Pat. No. 5,500,138, from column 7 line 42 to column 11 line 44. Perfume ingredients may also be suitably added as releasable fragrances, for example, as pro-perfumes or pro-fragrances as described in U.S. Pat. No. 5,652,205.

In one embodiment, more than 25% of the perfume ingredient(s) by weight of the perfume composition have a Log P higher than 2.5. Alternative embodiments include more than 35%, or more than 45%, or more than 50%, or more than 60%, or more than 70%, or more than 75% of perfume ingredient(s) by weight of the perfume composition have a Log P higher than 2.5.

In another embodiment, the perfume may comprise at least 1, or 2, or 3, or 4, or 5, or 6, or 7, or 8, or 9, or 10, or 11, or 12, alternatively not greater than about 100, different individual perfume ingredients.

Yet another aspect of the invention provides a concentrated perfume composition comprises a low level of water. In one embodiment, the water level in the concentrated perfume composition comprises less than 10%, or 9%, or 8%, or 7%, or 6%, or 5%, or 4%, or 3%, or 2%, or 1%, or less than 0.5%, alternatively greater than 0.5%, alternatively substantially free of water, alternatively combinations thereof, by weight of the concentrated perfume composition. When water is present in the concentrated perfume composition of the present invention, often mixing is necessary to maintain a homogeneous concentrated perfume composition.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution. In one embodiment, the solvent, diluent, or carrier level is less than 10%, or 9%, or 8%, or 7%, or 6%, or 5%, or 4%, or 3%, or 2%, or 1%, or 0.5%, or less than 0.1%, alternatively greater than 0.01%, or combinations thereof by weight of the concentrated perfume composition. In one embodiment, the concentrated perfume composition is free or substantially free of any solvents, diluents, or carriers.

In one embodiment, the concentrated perfume composition comprises from 25% to 95%, alternatively from 20% to 100%, alternatively from 65% to 95%, alternatively from 50% to 100% perfume ingredients by weight of the concentrated perfume composition.

Amphiphile

Another aspect of the invention provides an amphiphile. The amphiphile is according to Formula (I):

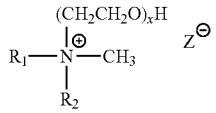

wherein $R_1$ is C6 to C22 alkyl, branched or unbranched, alternatively C12 to C18 alkyl, branched or unbranched. $R_2$ is nil, methyl, or —$(CH_2CH_2O)_y$, wherein y is from 2 to 20. When R2 is nil, the Nitrogen will be protonated. x is also from 2 to 20. Z is a suitable anionic counterion, preferably selected from the group consisting of chloride, bromide, methylsulfate, ethylsulfate, sulfate, and nitrate, more preferably chloride or methyl sulfate.

In one embodiment, the amphiphile is according to Formula (II):

(II)

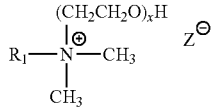

wherein x is from 2 to 20, and wherein $R_1$ is C6 to C22 alkyl, branched or unbranched, preferably C12 to C18 alkyl, branched or unbranched. Z is a suitable anionic counterion, preferably selected from the group consisting of chloride, bromide, methylsulfate, ethylsulfate, sulfate, and nitrate, more preferably chloride or methyl sulfate. An example of such a material is alkyl polyglycol ether ammonium methylchloride sold under the product name, for example, Berol R648 from Akzo Nobel.

In another embodiment, the surfactant is one according to Formula (III):

Formula (III)

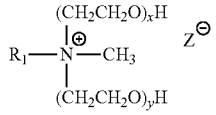

wherein x and y are each independently selection from 2 to 20, and wherein $R_1$ is C6 to C22 alkyl, branched or unbranched, preferably unbranched. In one embodiment, X+Y is from 2 to 40, preferably from 10 to 20. Z is a suitable anionic counterion, preferably chloride or methyl sulfate. An example of such a material is cocoalkylmethyl ethoxylated ammonium chloride sold under the product name, for example, ETHOQUAD C 25 from Akzo Nobel.

Another aspect of the invention provides for a method of making a perfumed fabric care composition comprising the step of adding the concentrated perfume composition of the present invention to a composition comprising one or more fabric softening actives, wherein preferably the composition comprising the fabric softening active is free or substantially free of a perfume. The concentrated perfume composition is combined with the composition comprising fabric softening active(s) such that the final fabric softener composition comprises at least 1.0%, alternatively at least 1.1%, or 1.3%, or 1.5%, or 1.7%, or 1.9%, or 2%, or 2.1%, or 2.3%, or 2.5%, or 2.7% or 3%, or from 1.0% to 4.0%, or from 1.5% to 3.5%, or combinations thereof, by weight of the final fabric softener composition.

The perfumed fabric care composition comprises a weight ratio of perfume to amphiphile of at least 3 to 1, alternatively 4:1, or 5:1, or 6:1, or 7:1, or 8:1, or 9:1, or 10:1, alternatively not greater than 100:1, respectively.

Mixing Amphiphile Perfume Composition

One aspect of the invention provides mixing an amphiphile with the neat perfume composition to obtain an amphiphile/perfume mixture. In one embodiment, the mixing of the amphiphile with the neat perfume composition is in a tank. In another embodiment, the mixing of the amphiphile with the neat perfume composition is in-line. This later embodiment, provides the advantage of so called "late product differentiation" such that a first, second, third, fourth, or more neat perfume compositions are held in different perfume composition tanks such that different perfumes may be dispensed during the manufacture process depending upon the scent variety of fabric softener desired to be made. Examples of "scent varieties" may include "APRIL FRESH" or "Clean Breeze" or "Mountain Spring" or the like. The amphiphile may be held in a separate tank and pumped in-line to be mixed with the appropriate neat perfume composition that is also pumped in-line to obtain the amphiphile/perfume mixture. It is this amphiphile/perfume mixture that is thereafter added to the fabric softener active composition (also preferably in-line). In yet another embodiment, the in-line mixing of the amphiphile with the neat perfume composition comprises static mixing with a static mixer. Static mixers are relatively low energy, low capital, low maintenance and thus desirable from a manufacturing perspective.

Alternatively, the amphiphile/perfume mixture is obtained from a supplier. In one embodiment, first, second, third, fourth, or more neat amphiphile/perfume mixtures are held in different perfume composition tanks such that different perfumes may be dispensed during the manufacture process depending upon the scent variety of fabric softener desired to be made.

The amphiphile/perfume mixture may comprises 30% to 95%, alternatively 65% to 95% of perfume ingredients.

The amphiphile/perfume mixture comprises 5% to 70%, alternatively 5% to 35% of the amphiphile.

The amphiphile of the present invention is preferably at a level from 0.1% to 2.0%, alternatively 0.1% to 0.5% in the fabric softener composition.

The fabric softener composition comprises 1.0% to 2.5%, alternatively 1.5% to 2.5% of free perfume by weight of the fabric softener composition.

Adjunct Ingredients

In another aspect the method further comprises adding adjunct ingredients to the composition as part of so called "late product differentiation." Adjunct ingredients may include: a perfume microcapsule, dispersing agent, stabilizer, pH control agent, metal ion control agent, colorant, brightener, dye, odor control agent, pro-perfume, cyclodextrin, solvent, soil release polymer, preservative, antimicrobial agent, chlorine scavenger, enzyme, anti-shrinkage agent, fabric crisping agent, silicone (e.g., PDMS), spotting agent, antioxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, anti-microbial, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, and rinse aid, UV protection agent, sun fade inhibitor, insect repellent, anti-allergenic agent, enzyme, flame retardant, water proofing agent, fabric comfort agent, water conditioning agent, shrinkage resistance agent, stretch resistance agent, enzymes, cationic starch, and combinations thereof. In one embodiment, the composition comprises one or more adjunct ingredient up to about 2% by weight of the fabric softener composition. In yet another embodiment, the fabric softener composition of the present invention may be free or essentially free of any one or more adjunct ingredients. In yet another embodiment, the fabric softener composition is free or essentially free of detersive laundry surfactants. In one embodiment, the pH of the fabric softener composition may comprise a pH of from 2 to 6, preferably from 2 to 5, and more preferably from 2.5 to 4.

All documents cited in the DETAILED DESCRIPTION OF THE INVENTION are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a perfumed fabric softener composition comprising the steps:

(i) mixing an amphiphile with a neat perfume composition comprising 1.0% to 2.5% of perfume ingredients by weight of the perfume composition to obtain an amphiphile/perfume mixture, wherein the amphiphile comprises a compound of formula (I):

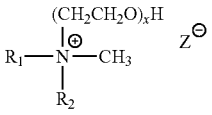

wherein:

$R_1$ is C6 to C22 alkyl, branched or unbranched;

$R_2$ is nil, or hydrogen;

x is from 2 to 20; and

Z is an anionic counterion;

(ii) adding the amphiphile/perfume mixture to a fabric softener active composition comprising 10% to 20% by weight of the fabric softener active composition of a bis-(2-hydroxyethyl)-dimethylammonium chloride fatty acid ester having an average chain length of the fatty acid moieties of from 16 to 20 carbon atoms, and an Iodine Value (IV), calculated for the free fatty acid, of from 15 to 25 to make the perfume fabric softener composition.

2. The method of claim 1, wherein the mixing of the amphiphile with the neat perfume composition is in a tank.

3. The method of claim 1, wherein the mixing of the amphiphile with the neat perfume composition is in-line.

4. The method of claim 3, wherein the in-line mixing of the amphiphile with the neat perfume composition comprises static mixing with a static mixer.

5. The method of claim 4, wherein the fabric softener active composition is substantially free of neat perfume, and wherein the perfumed fabric softener composition comprises at least 1.0% free perfume by weight of the perfume fabric softener composition.

6. The method of claim 5, wherein the neat perfume composition has a combined dielectric constant from 1 to 9.

7. The method of claim 6, wherein the neat perfume composition is comprises of perfume ingredients, wherein at least 50% of the perfume ingredients, by weight of the neat perfume composition, comprises a have a Log P higher than 2.5.

8. The method of claim 7, wherein $R_2$ of the amphiphile is hydrogen.

9. The method of claim 8, wherein the amphiphile/perfume mixture comprises from 5% to 70% of the amphiphile.

10. The method of claim 9, wherein the perfumed composition comprises from 30% to 95% of the amphiphile.

11. A method of making a perfumed fabric softener composition comprising combining an amphiphile/perfume mixture, wherein the amphiphile of the amphiphile/perfume mixture comprises a compound of wherein the amphiphile comprises a compound of formula (I):

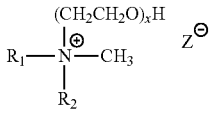

wherein:

$R_1$ is C6 to C22 alkyl, branched or unbranched;

$R_2$ is nil, or hydrogen;

x is from 2 to 20; and

Z is a anionic counterion; and a fabric softener active composition comprising 10% to 20% by weight of the fabric softener active composition of a bis-(2-hydroxyethyl)-dimethylammonium chloride fatty acid ester having an average chain length of the fatty acid moieties of from 16 to 20 carbon atoms, and an Iodine Value (IV), calculated for the free fatty acid, of from 15 to 25; to make the perfumed fabric softener composition.

12. The method of claim 11, wherein the fabric softener active composition is substantially free of neat perfume; and wherein the perfumed fabric softener composition comprises at least 1.0% free perfume by weight of the perfumed fabric softener composition.

13. The method of claim 12, wherein the perfumed fabric softener composition comprises from 0.10% to 2.0% of the amphiphile.

14. The method of claim 13, wherein the perfumed fabric softener composition comprises: (a) from 0.1% to 0.5% of the amphiphile; and (b) from 1.0% to 2% of free perfume, by weight of the perfumed fabric softener composition.

15. The method of claim 14, wherein the neat perfume composition comprises perfume ingredients, wherein at least 60% of the perfume ingredients, by weight of the neat perfume composition, comprises a have a Log P higher than 2.5.

16. The method of claim 15, wherein the neat perfume composition has a combined dielectric constant from 1 to 7.

17. The method of claim 16, wherein the amphiphile/perfume mixture comprises 5% to 70% of the amphiphile by weight; and wherein the bis-(2-hydroxyethyl)-dimethylammonium chloride fatty acid ester has an IV of from 18 to 22.

18. The method of claim 17, further comprising the step of static mixing the amphiphile/perfume mixture to the fabric softener active composition with a static mixer.

19. The method of claim 17, wherein $R_2$ of the amphiphile is hydrogen, and wherein x of the amphiphile is from 2 to 20.

20. The method of claim 19, wherein the $R_1$ of the amphiphile is a C6 to C22 linear alkyl group.

* * * * *